US012180679B2

(12) United States Patent
Ishii

(10) Patent No.: US 12,180,679 B2
(45) Date of Patent: Dec. 31, 2024

(54) SHOVEL

(71) Applicant: SUMITOMO CONSTRUCTION MACHINERY CO., LTD., Tokyo (JP)

(72) Inventor: Nobuyuki Ishii, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 350 days.

(21) Appl. No.: 17/647,868

(22) Filed: Jan. 13, 2022

(65) Prior Publication Data

US 2022/0136206 A1 May 5, 2022

Related U.S. Application Data

(63) Continuation of application No. PCT/JP2020/028940, filed on Jul. 28, 2020.

(30) Foreign Application Priority Data

Jul. 29, 2019 (JP) ..... 2019-138859

(51) Int. Cl.

| | |
|---|---|
| ***E02F 3/32*** | (2006.01) |
| ***E02F 9/08*** | (2006.01) |
| ***E02F 9/20*** | (2006.01) |
| ***E02F 9/22*** | (2006.01) |

(52) U.S. Cl.

CPC ..... *E02F 9/0866* (2013.01); *E02F 3/32* (2013.01); *E02F 9/2004* (2013.01); *E02F 9/226* (2013.01)

(58) Field of Classification Search

CPC ..... E02F 9/0866; E02F 3/32; E02F 9/2004; E02F 9/226; E02F 9/20; E02F 3/43; E02F 9/26

USPC ..... 180/68.1

See application file for complete search history.

(56) References Cited

U.S. PATENT DOCUMENTS

| | | | | |
|---|---|---|---|---|
| 9,464,409 | B2 * | 10/2016 | Magaki | E02F 9/26 |
| 10,604,382 | B2 * | 3/2020 | Morimoto | B01D 53/9431 |
| 10,700,511 | B2 * | 6/2020 | Nakamura | H02H 6/00 |
| 11,133,124 | B2 * | 9/2021 | Inkinen | H01F 7/206 |
| 2004/0030919 | A1 * | 2/2004 | Moriya | E02F 9/2296 726/35 |

(Continued)

FOREIGN PATENT DOCUMENTS

| | | | |
|---|---|---|---|
| EP | 1591648 | | 11/2005 |
| JP | 06280289 A | * | 3/1993 |

(Continued)

OTHER PUBLICATIONS

Translation of JP 06280289A accessed at www.google.com/patents on Feb. 10, 2024. (Year: 1993).*

(Continued)

*Primary Examiner* — John D Walters
*Assistant Examiner* — Hilary L Johns
(74) *Attorney, Agent, or Firm* — IPUSA, PLLC

(57) ABSTRACT

A shovel includes an upper swing structure, a lower traveling structure, a first switch configured to stop an engine, and a hardware processor configured to control the engine. The hardware processor is configured to determine to start an automatic cooling operation in response to recognizing a predetermined operation and recognizing that an operation to stop the engine has been performed on the first switch.

12 Claims, 5 Drawing Sheets

(56) References Cited

U.S. PATENT DOCUMENTS

| | | | | |
|---|---|---|---|---|
| 2005/0193747 | A1* | 9/2005 | Kajimoto | B60H 1/00778 62/133 |
| 2014/0297156 | A1* | 10/2014 | Magaki | E02F 9/26 701/101 |
| 2015/0015103 | A1* | 1/2015 | Isoda | F01P 7/026 310/71 |
| 2015/0029629 | A1* | 1/2015 | Nakamura | H02H 5/04 361/93.8 |
| 2017/0240387 | A1* | 8/2017 | Morimoto | F01N 11/00 |
| 2017/0248946 | A1* | 8/2017 | Ogura | A01B 69/008 |
| 2018/0057319 | A1* | 3/2018 | Hirate | B66C 13/00 |
| 2019/0170052 | A1* | 6/2019 | Dudar | F02D 41/0087 |
| 2020/0291610 | A1 | 9/2020 | Misaki | |

FOREIGN PATENT DOCUMENTS

| | | |
|---|---|---|
| JP | H06-280289 | 10/1994 |
| JP | H09-105339 | 4/1997 |
| JP | H10-089119 | 4/1998 |
| JP | H11-013607 | 1/1999 |
| JP | 2003-003899 | 1/2003 |
| JP | 2008-240558 | 10/2008 |
| WO | 2019/112063 | 6/2019 |

OTHER PUBLICATIONS

International Search Report for PCT/JP2020/028940 mailed on Oct. 20, 2020.

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/028940, filed on Jul. 28, 2020 and designating the U.S., which claims priority to Japanese Patent Application No. 2019-138859, filed on Jul. 29, 2019. The entire contents of the foregoing applications are incorporated herein by reference.

BACKGROUND

Technical Field

The present invention relates to shovels.

Description of Related Art

A shovel drives a hydraulic pump with an engine to drive parts of the shovel. When the engine is stopped, a cooling pump that supplies cooling water to the engine and the cooling fan of a radiator also stop. Therefore, an automatic cooling operation to automatically stop the engine after cooling the engine by running the engine with a low load (in the idle state) after the shovel finishes work is known. This can prevent the engine from stopping while its temperature is high, thus making it possible to prevent the engine from burning out. Furthermore, because the engine automatically stops after the cooling of the engine, it is possible to prevent unnecessary operation in the idle state.

An automatic cooling operation device provided in a hydraulic work machine that includes an engine, a hydraulic pump driven by the engine, an actuator driven with hydraulic oil discharged from the hydraulic pump, a directional control valve that controls the direction of hydraulic oil supplied from the hydraulic pump to the actuator, and an operating device that switches the directional control valve is known. The automatic cooling operation device stops the engine after continuing to drive the engine for a predetermined period of time when a start switch for staring the engine is turned OFF.

SUMMARY

According to an aspect of the present invention, a shovel includes an upper swing structure, a lower traveling structure, a first switch configured to stop an engine, and a hardware processor configured to control the engine. The hardware processor is configured to determine to start an automatic cooling operation in response to recognizing a predetermined operation and recognizing that an operation to stop the engine has been performed on the first switch.

DETAILED DESCRIPTION

Figure 1:
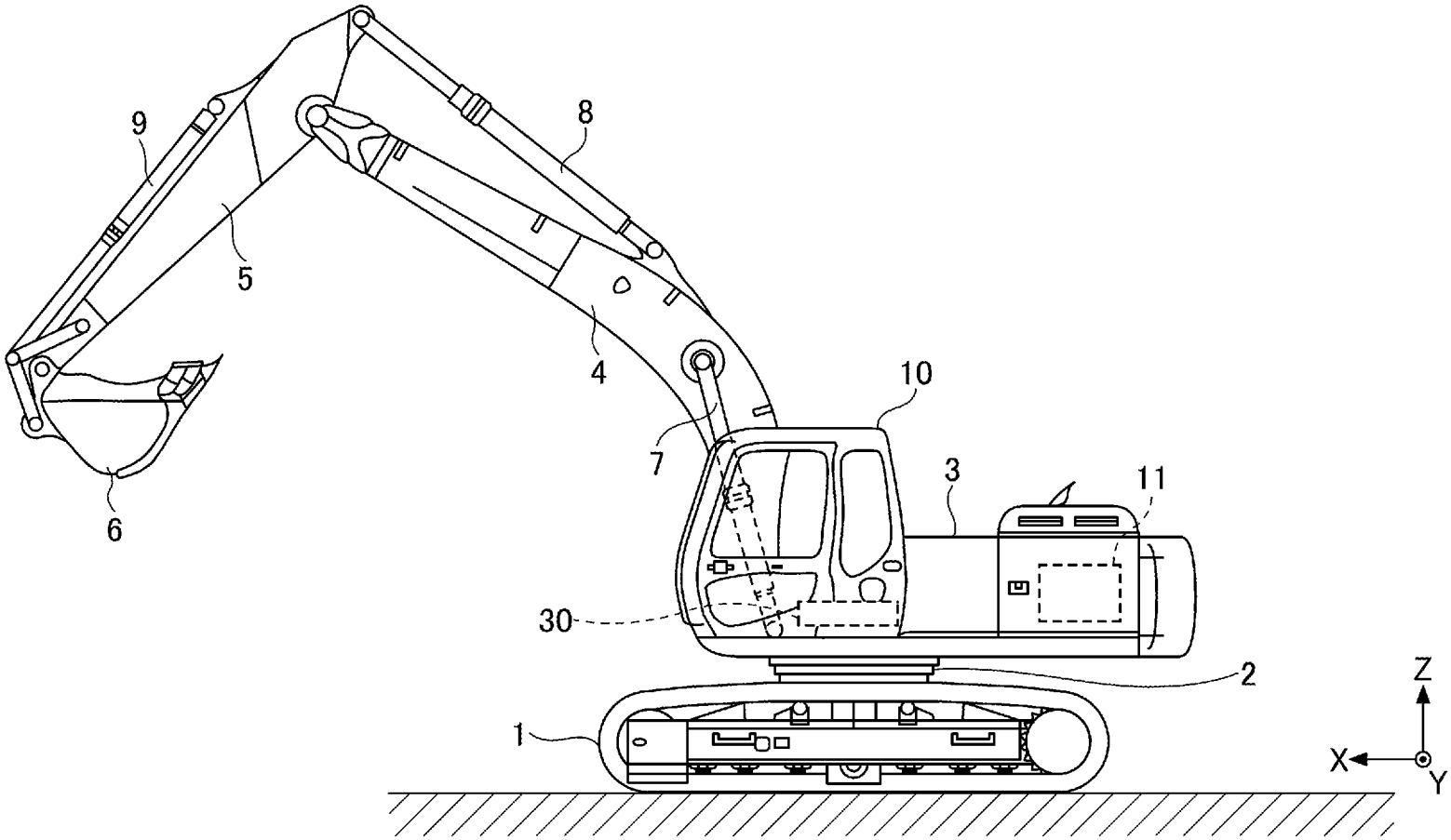
FIG. 1 is a side view of a shovel according to an embodiment.

According to the related-art hydraulic work machine, when an operator unaware of equipment with an automatic cooling operation function rides, the engine does not turn off against the operator's intention.

Thus, a shovel that provides a better operation feeling is desired.

According to an embodiment of the present invention, it is possible to provide a shovel that provides a better operation feeling.

An embodiment is described below with reference to the accompanying drawings. To facilitate the understanding of the description, the same constituent elements are given the same reference numerals in the drawings to the extent possible, and a duplicate description thereof is omitted.

In the following description, the X direction, the Y direction, and the Z direction are directions perpendicular to one another. Typically, the X direction and the Y direction are horizontal directions, and the Z direction is a vertical direction. The X direction is the longitudinal direction of the shovel. The X direction is positive on the front side and negative on the back side. The Y direction is the lateral widthwise direction of the shovel. The Y direction is positive on the left side and negative on the right side. The Z direction is the height direction of the shovel. The Z direction is positive on the upper side and negative on the lower side.

First, the overall configuration of a shovel according to this embodiment is described with reference to FIG. 1. FIG. 1 is a side view of the shovel (excavator) according to this embodiment.

As illustrated in FIG. 1, an upper swing structure 3 is swingably mounted on a lower traveling structure 1 of the shovel via a swing mechanism 2. A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment that is an example of an attachment, and are hydraulically driven by a boom cylinder 7, an arm cylinder 8, and a bucket cylinder 9, respectively. A cabin 10 that is a cab is provided and a power source such as an engine 11 is mounted on the upper swing structure 3.

A controller 30 is installed in the cabin 10. The controller 30 operates as a main control part to control the driving of the shovel. According to this embodiment, the controller 30 is constituted of a computer including a CPU (processor), a RAM, and a ROM. Various functions of the controller 30 are implemented by the CPU executing programs stored in the ROM, for example.

Figure 2:
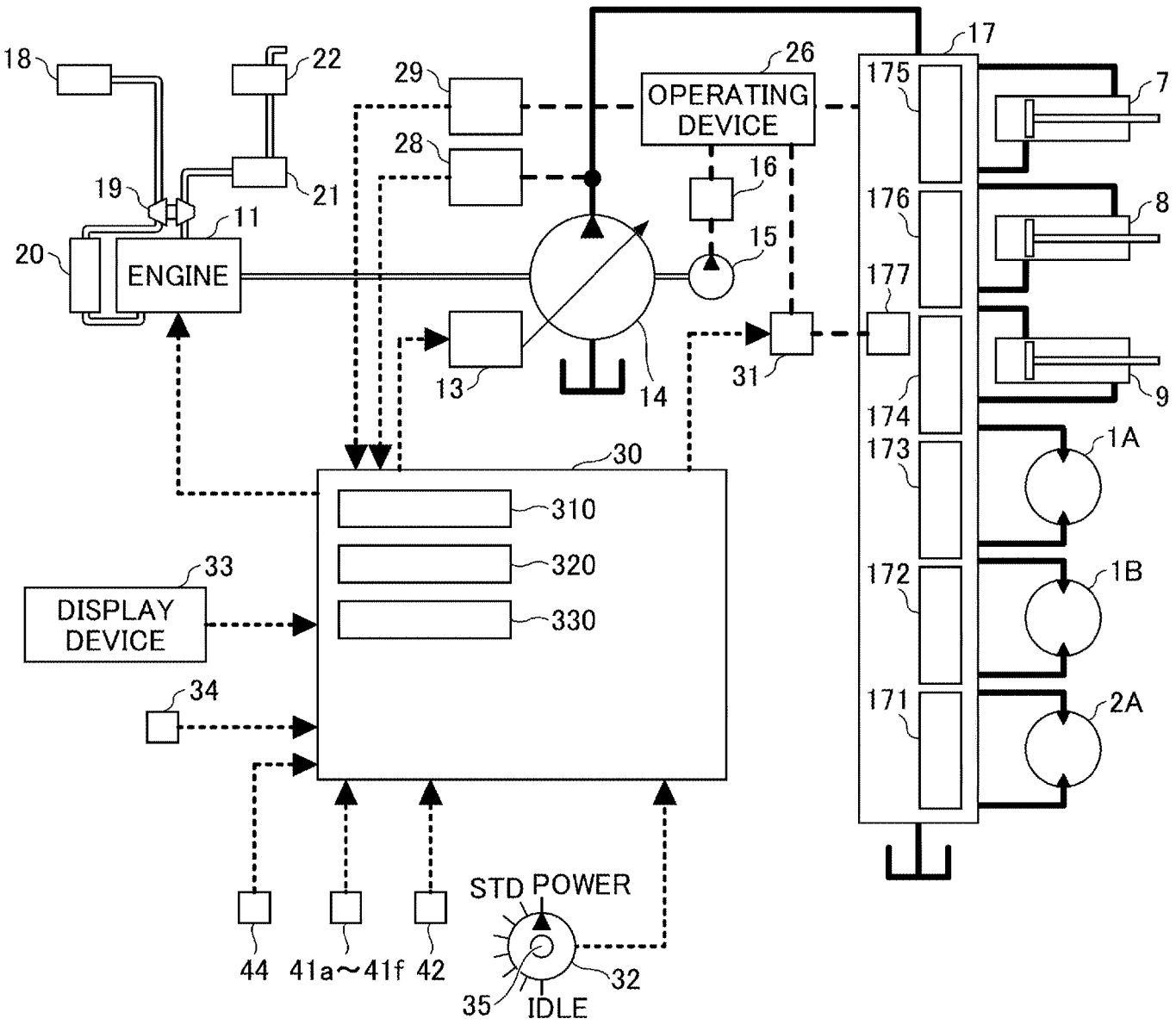
FIG. 2 is a block diagram illustrating an example configuration of a drive system of the shovel of FIG. 1.

Next, a configuration of the drive system of the shovel of FIG. 1 is described with reference to FIG. 2. FIG. 2 is a block diagram illustrating an example configuration of the drive system of the shovel of FIG. 1. In FIG. 2, a mechanical power system, a high pressure hydraulic line, a pilot line, and an electrical control system are indicated by a double line, a thick bold line, a dashed line, and a dotted line, respectively.

As illustrated in FIG. 2, the drive system of the shovel mainly includes the engine 11, a regulator 13, a main pump 14, a pilot pump 15, a gate lock valve 16, a control valve 17, an air cleaner 18, a turbocharger 19, a heat exchanger unit 20, an exhaust gas treatment unit 21, a muffler 22, an operating device 26, a discharge pressure sensor 28, an operating pressure sensor 29, the controller 30, a proportional valve 31, a dial 32, a display device 33, and a group of switches 41*a* through 41*f*.

The engine 11 is a drive source of the shovel. According to this embodiment, the engine 11 is, for example, a diesel engine that operates to maintain a predetermined rotational speed. Furthermore, the output shaft of the engine 11 is connected to the input shafts of the main pump 14 and the pilot pump 15. Furthermore, the output shaft of the engine 11 is connected to the input shaft of a cooling pump (not depicted). The engine 11 is put in motion and the cooling pump circulates cooling water between the engine 11 and a radiator (not depicted). Furthermore, the engine 11 is stopped to also stop the cooling pump. The radiator radiates the heat of a coolant to the atmosphere. The radiator is provided with a cooling fan (not depicted) that takes in outside air to blow it through the radiator. The cooling fan may be connected to the output shaft of the engine 11 or may be an electric motor. The operation of the cooling fan is linked to the operation and stop of the engine 11, for example.

The main pump 14 supplies hydraulic oil to the control valve 17 via a high pressure hydraulic line. According to this embodiment, the main pump 14 is a swash plate variable displacement hydraulic pump.

The regulator 13 controls the discharge quantity of the main pump 14. According to this embodiment, the regulator 13 controls the discharge quantity of the main pump 14 by adjusting the swash plate tilt angle of the main pump 14 in response to a control command from the controller 30.

The pilot pump 15 supplies hydraulic oil to various hydraulic controllers including the operating device 26 via a pilot line. According to this embodiment, the pilot pump 15 is a fixed displacement hydraulic pump.

The gate lock valve 16 is configured to be able to switch the opening and closing of a pilot line connecting the pilot pump 15 and the operating device 26. When the pilot line is open, the operating device 26 is enabled. When the pilot line is closed, the operating device 26 is disabled. The enablement of the operating device 26 indicates that an operation on the operating device 26 is to be reflected in the motion of the shovel. The disablement of the operating device 26 indicates that an operation on the operating device 26 is not to be reflected in the motion of the shovel. Furthermore, the gate lock valve 16 opens the pilot line when a gate lock lever 140 (see FIG. 3 described below) is pulled up, and closes the pilot line when the gate lock lever 140 is pushed down. The gate lock valve 16 may also be configured to be able to switch the opening and closing of the pilot line in response to a control command from the controller 30.

In the case of restarting the engine 11 after the engine 11 is stopped, for example, when an ignition switch 42 is operated so that a command to start the engine 11 is input to the controller 30, the controller 30 restarts the engine 11 on condition that the gate lock valve 16 is closed (in a locking state). This makes it possible to disable the operating device 26 when restarting the engine 11, so that it is possible to prevent the shovel from moving immediately after the restart of the engine 11.

The control valve 17 is a hydraulic controller that controls a hydraulic system in the shovel. The control valve 17 includes control valves 171 through 176 and a bleed valve 177. The control valve 17 can selectively supply hydraulic oil discharged by the main pump 14 to one or more hydraulic actuators through the control valves 171 through 176. The control valves 171 through 176 controls the flow rate of hydraulic oil flowing from the main pump 14 to the hydraulic actuators and the flow rate of hydraulic oil flowing from the hydraulic actuators to a hydraulic oil tank. The hydraulic actuators include the boom cylinder 7, the aim cylinder 8, the bucket cylinder 9, a left travel hydraulic motor 1A, a right travel hydraulic motor 1B, and a swing hydraulic motor 2A. The bleed valve 177 controls the flow rate of part of the hydraulic oil discharged by the main pump 14 which part bypasses the hydraulic actuators to flow into the hydraulic oil tank (hereinafter "bleed flow rate"). The bleed valve 177 may also be provided outside the control valve 17.

The air cleaner 18 filters air introduced into the engine 11. Air taken in through the air cleaner 18 is compressed in the compressor of the turbocharger 19 and cooled by the heat exchanger unit 20 to reach the combustion chamber of the engine 11. Furthermore, exhaust gas discharged from the engine 11 rotates the turbine of the turbocharger 19 and is converted and purified in the exhaust gas treatment unit 21, and is thereafter released into the atmosphere from the muffler (silencer) 22. The exhaust gas treatment unit 21 may include a selective catalytic reduction (SCR) system and a diesel particulate filter (DPF).

The operating device 26 is a device that the operator uses to operate the hydraulic actuators. According to this embodiment, the operating device 26 supplies hydraulic oil discharged by the pilot pump 15 to a pilot port of a control valve corresponding to a hydraulic actuator via a pilot line. The pressure of hydraulic oil supplied to the pilot port (pilot pressure) is a pressure commensurate with the direction of operation and the amount of operation of a lever or pedal (see FIGS. 3 and 4) of the operating device 26 corresponding to the hydraulic actuator.

The discharge pressure sensor 28 detects the discharge pressure of the main pump 14. According to this embodiment, the discharge pressure sensor 28 outputs a detected value to the controller 30.

The operating pressure sensor 29 detects the details of the operator's operation using the operating device 26. According to this embodiment, the operating pressure sensor 29 detects the direction of operation and the amount of operation of a lever or pedal of the operating device 26 corresponding to a hydraulic actuator in the form of pressure (operating pressure), and outputs a detected value to the controller 30. The operation details of the operating device 26 may also be detected using a sensor other than an operating pressure sensor.

The proportional valve 31 operates in response to a control command output by the controller 30. According to this embodiment, the proportional valve 31 is a solenoid valve that adjusts a secondary pressure introduced to the pilot port of the bleed valve 177 in the control valve 17 from the operating device 26, in response to a current command output by the controller 30. The proportional valve 31, for example, operates in such a manner as to increase the secondary pressure introduced to the pilot port of the bleed valve 177 as the current command increases.

The dial 32 is a rotary knob for the operator selecting the rotational speed of the engine 11. The dial 32 can adjust the engine rotational speed by rotating. Furthermore, the dial 32 is provided with an output characteristic change switch 35. The output characteristic of the shovel can be changed by depressing the output characteristic change switch 35.

The dial 32 allows the engine rotational speed to be selected from multiple levels. These levels include, for example, POWER MODE, STD MODE and IDLE MODE as illustrated in FIG. 2. POWER MODE, which is a work mode selected when it is desired to prioritize workload, uses the highest engine rotational speed and uses the highest acceleration/deceleration characteristic. STD MODE, which is a work mode selected when it is desired to satisfy both workload and fuel efficiency, uses the second highest engine rotational speed and uses the second highest acceleration/deceleration characteristic. IDLE MODE, which is a work mode selected when it is desired to idle the engine 11, uses the lowest engine rotational speed and uses the lowest acceleration/deceleration characteristic.

Furthermore, the output characteristic can be switched between the two levels of a normal characteristic and a low fuel consumption characteristic, using the output characteristic change switch 35, for example. The low fuel consumption characteristic is an output characteristic selected when it is desired to moderate the acceleration characteristic or deceleration characteristic of a hydraulic actuator responsive to a lever operation to improve operational accuracy and safety and operate the shovel with low noise. For example, for the low fuel consumption characteristic, the engine output torque diagram is changed. Specifically, an engine output torque diagram of the low fuel consumption characteristic is prepared in addition to an engine output torque diagram of the normal characteristic, and the output characteristic change switch 35 is pressed to change the engine output torque diagram. That is, when the output characteristic is set to the low fuel consumption characteristic, the engine output torque diagram is changed to that of smaller torque. Furthermore, for example, for the low fuel consumption characteristic, the engine rotational speed may be reduced by a predetermined value on the same engine output torque diagram (the engine output torque diagram of the normal characteristic). Specifically, the engine rotational speed is reduced by a predetermined value at each level of the dial 32. At this point, the maximum engine rotational speed of the low fuel consumption characteristic may be lower than the maximum engine rotational speed of the normal characteristic. Thus, the low fuel consumption characteristic makes it possible to operate the shovel with lower fuel consumption than the normal characteristic by controlling the engine 11. Here, for the low fuel consumption characteristic, the engine rotational speed may be reduced by a predetermined value in addition to changing the engine output torque diagram of the normal characteristic to another engine output torque diagram.

The dial 32 and the output characteristic change switch 35 constantly transmit information on the setting of the engine rotational speed and the output characteristic to the controller 30. The controller 30 controls the rotational speed of the engine 11 at the engine rotational speed set with the dial 32.

Furthermore, various kinds of information are input to the controller 30 from a group of display device side switches 34, the group of switches 41*a* through 41*f*, the ignition switch 42, and a group of switches 44.

Furthermore, the controller 30 includes a determination part 310, an operation control part 320, and a setting part 330. The determination part 310 determines whether to perform an automatic cooling operation. The operation control part 320 controls the operation of the shovel. The setting part 330 sets the various parameters of the automatic cooling operation. These configurations are described below.

Figure 3:
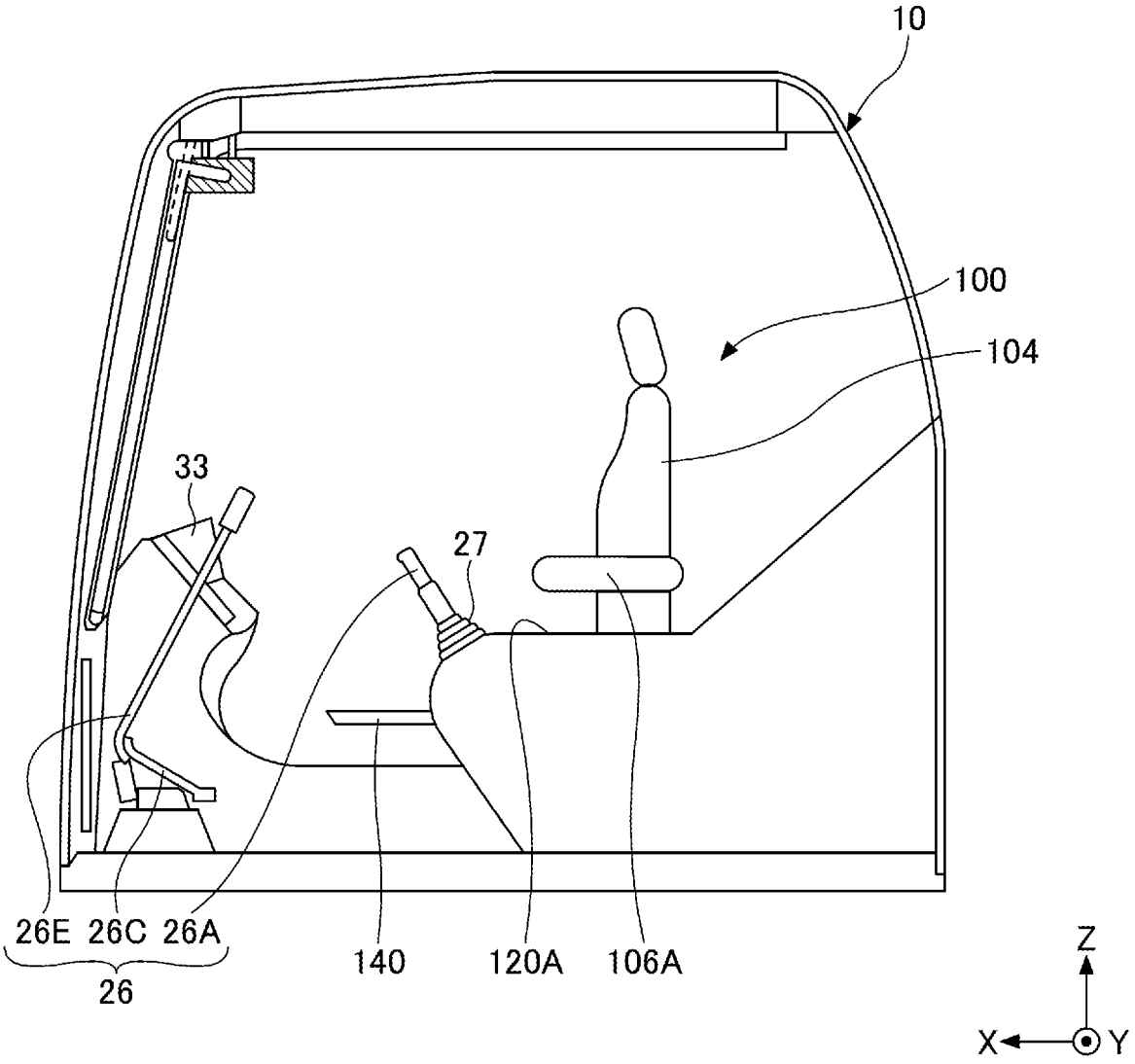
FIG. 3 is a left side view of the inside of a cabin as viewed from the positive side of the Y direction.
Figure 4:
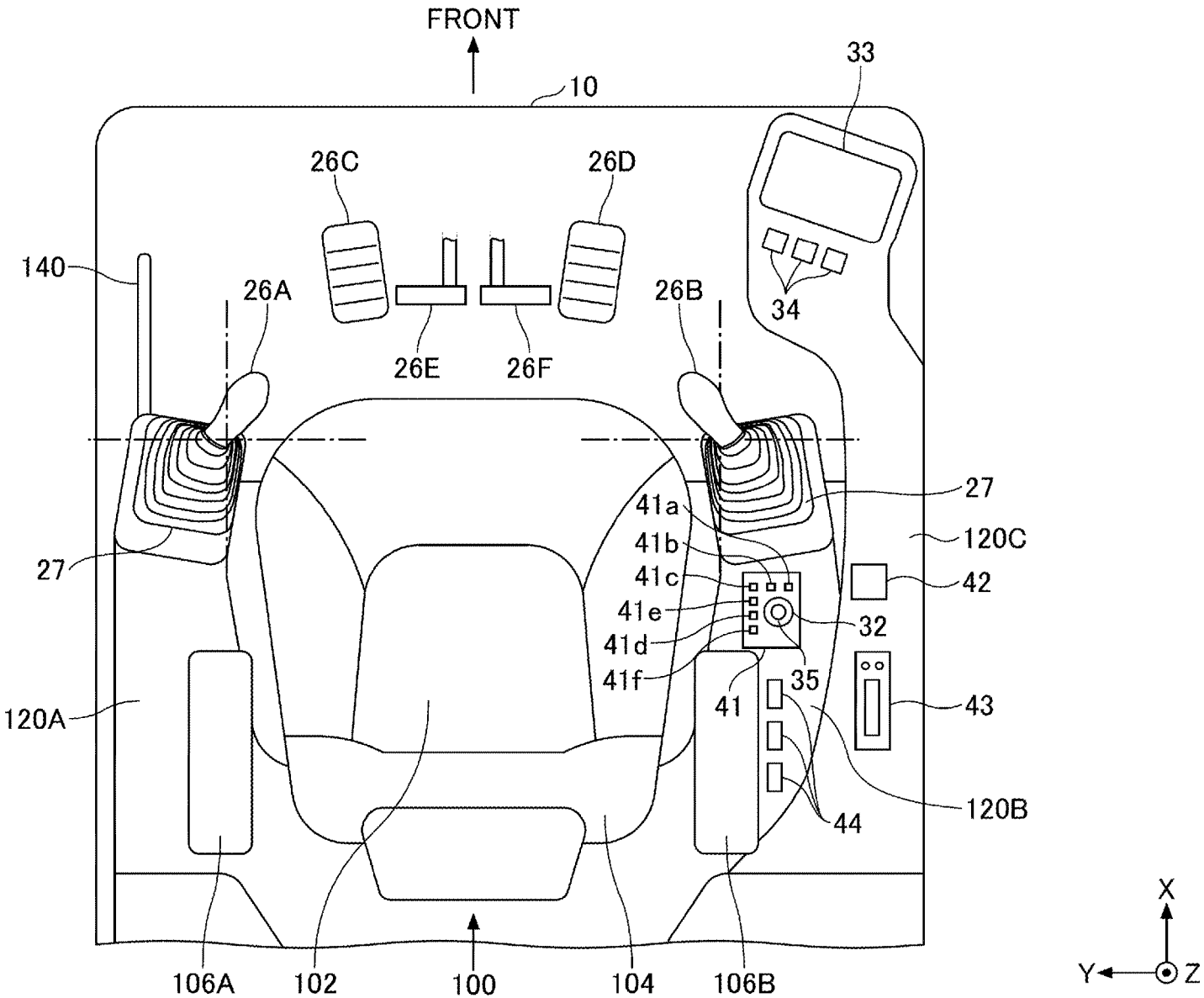
FIG. 4 is a plan view of the inside of the cabin as viewed from the positive side of the Z direction.

Next, an operator seat 100 and the operating device 26 installed in the cabin 10 are described with reference to FIGS. 3 and 4. FIG. 3 is a left side view of the inside of the cabin 10 as viewed from the positive side of the Y direction. FIG. 4 is a plan view of the inside of the cabin 10 as viewed from the positive side of the Z direction.

The operator seat 100 is installed in the cabin 10. The operator seat 100 includes a seat 102 in which the operator sits and a back 104. The operator seat is a recliner and the inclination angle of the back 104 is adjustable. A left armrest 106A and a right armrest 106B are disposed on the left side and the right side, respectively, of the operator seat 100. The left armrest 106A and the right armrest 106B are pivotably supported.

A seat left side console 120A and a seat right side console 120B are disposed on the left side and the right side, respectively, of the operator seat 100. The seat left side console 120A and the seat right side console 120B are so provided as to extend along the front-to-back direction of the operator seat. The operator seat 100 is configured to be slidable forward and backward. Accordingly, the operator can move and fix the operator seat 100 to a desired position relative to a left travel lever 26E, a right travel lever 26F, the windshield of the cabin 10, the seat left side console 120A, and the seat right side console 120B. Here, the operator seat 100 may be configured to be movable forward and backward together with the seat left side console 120A, the seat right side console 120B, the left armrest 106A, and the right armrest 106B.

A left operating lever 26A is provided at the front of the seat left side console 120A. Likewise, a right operating lever 26B is provided at the front of the seat right side console 120B. The operator seated in the operator seat 100 operates the left operating lever 26A while holding the left operating lever 26A with the left hand, and operates the right operating lever 26B while holding the right operating lever 26B with the right hand. The operator seated in the operator seat 100 operates the left operating lever 26A with the left hand to drive the arm cylinder 8 and the swing hydraulic motor 2A. Furthermore, the operator seated in the operator seat 100 operates the right operating lever 26B with the right hand to drive the boom cylinder 7 and the bucket cylinder 9.

The left operating lever 26A and the right operating lever 26B are covered with respective lever covers 27 on their base side. As a result, the left operating lever 26A and the right operating lever 26B are steplessly and continuously connected to the surfaces of the seat left side console 120A and the seat right side console 120B, respectively.

A left travel pedal 26C and a right travel pedal 26D are disposed on a floor in front of the operator seat 100. The operator seated in the operator seat 100 operates the left travel pedal 26C with the left foot to drive the left travel hydraulic motor LA. Furthermore, the operator seated in the operator seat 100 operates the right travel pedal 26D with the right foot to drive the right travel hydraulic motor 1B.

The left travel lever 26E extends upward from the vicinity of the left travel pedal 26C. The operator seated in the operator seat 100 can drive the left travel hydraulic motor 1A by operating the left travel lever 26E while holding the left travel lever 26E with the left hand, the same as in the operation with the left travel pedal 26C. Furthermore, the right travel lever 26F extends upward from the vicinity of the right travel pedal 26D. The operator seated in the operator seat 100 can drive the right travel hydraulic motor 1B by operating the right travel lever 26F while holding the right travel lever 26F with the right hand, the same as in the operation with the right travel pedal 26D.

The display device 33 that displays information such as the work conditions and the operating condition of the shovel is placed on the front right in the cabin 10. The operator seated in the operator seat 100 can perform work with the shovel while checking various kinds of information displayed on the display device 33. The display device 33 is provided with, for example, the group of display device side switches 34 for display control of the display device 33.

Furthermore, the gate lock lever 140 is provided on the left side of the operator seat 100 (namely, on the entrance/exit door side of the cabin 10). Pulling up the gate lock lever 140 allows the engine 11 to start, thus making it possible to operate the shovel. Pushing down the gate lock lever 140 disables an operating part including the engine 11 from starting. Accordingly, unless the operator sits in the operator seat and pulls up the gate lock lever 140, the shovel cannot operate and the safety is maintained.

A window side console 120C is installed to the right of the seat right side console 120B on the right side of the operator seat 100. The window side console 120C, for example, extends along the front-to-back direction of the cabin 10 and is provided parallel to the seat right side console 120B. The display device 33 may be installed at the front of the window side console 120C, for example. The ignition switch 42, a radio 43, etc., are installed on the window side console 120C. Here, the ignition switch 42, the radio 43, etc., may be installed on the seat left side console 120A or the seat right side console 120B.

The ignition switch (first switch) 42 is a switch to switch the start and stop of the engine 11. The ignition switch 42 may be either a key switch or a push switch, for example.

The left armrest 106A and the right armrest 106B are placed above the seat left side console 120A and the seat right side console 120B, respectively. The left armrest 106A and the right armrest 106B are placed such that at least part of the left armrest 106A and at least part of the right armrest 106B conceal a back portion of the seat left side console 120A and a back portion of the seat right side console 120B, respectively, when viewed in the Z direction.

Furthermore, a switch panel 41 is placed between the right armrest 106B and the right operating lever 26B on the seat right side console 120B. The switch panel 41 includes the group of switches 41*a* through 41*f* and the dial 32. The output characteristic change switch 35 is provided on the dial 32. Furthermore, the group of switches 44 is placed on the back side of the switch panel 41.

Figure 5:
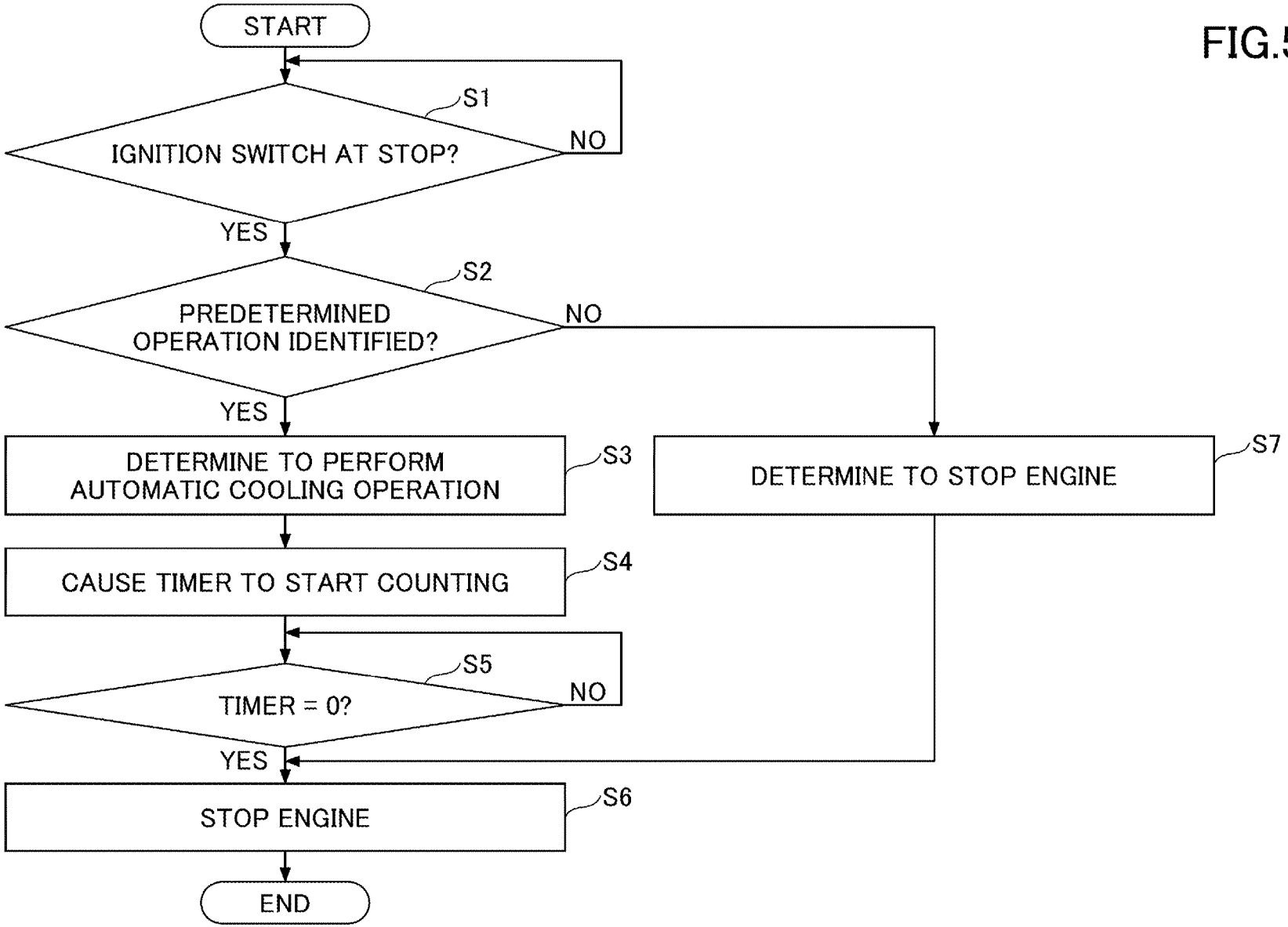
FIG. 5 is a flowchart illustrating an operation in the case of stopping an engine of the shovel according to the embodiment.

Next, an operation in the case of stopping the engine 11 of the shovel is described using FIG. 5. FIG. 5 is a flowchart illustrating an operation in the case of stopping the engine 11 of the shovel according to this embodiment.

It is assumed that the engine 11 is in operation at the start of the flow illustrated in FIG. 5.

At step S1, the determination part 310 determines whether the ignition switch 42 has been operated to be in "STOP" state. Here, "STOP" state is a state in which to command the stop of the engine 11, and indicates turning a key to "STOP" position in the case of a key switch and indicates pushing a switch in the case of a push switch, for example. If the ignition switch 42 has been operated to be in "STOP" state (S1 •YES), the process of the controller 30 proceeds to step S2. If the ignition switch 42 has not been operated to be in "STOP" state (S1 •N0), the process of the controller 30 repeats step S1 until the operation is performed.

At step S2, the determination part 310 determines whether a predetermined operation to activate the function of a cooling operation has been identified at the same time with the operation of the ignition switch 42 into "STOP" state. Here, the predetermined operation is, for example, the operation of a switch to which an automatic cooling operation is assigned. The switch to which the automatic cooling operation is assigned is assigned to a switch (second switch) among the group of display device side switches 34, the group of switches 41*a* through 41*f*, and the group of switches 44. Furthermore, the display device 33 may be a display and input device such as a touchscreen, and the switch to which the automatic cooling operation is assigned may be provided on the screen of the display device 33. The switch to which the automatic cooling operation is assigned may be, for example, a momentary action switch that turns ON only during its pressing, and the operation of the switch may be, for example, pressing the switch. Furthermore, the determination of a predetermined operation by the determination part 310 does not have to be simultaneous with the operation of the ignition switch 42 into "STOP" state. Whether a predetermined operation has been identified may be determined within a predetermined period of time (for example, within 10 seconds) after the operation of the ignition switch 42 into "STOP" state.

In response to identifying a predetermined operation (S2 •YES), the process of the controller 30 proceeds to step S3. In response to not identifying a predetermined operation (S2 •NO), the process of the controller 30 proceeds to step S7.

At step S3, the determination part 310 determines to perform the automatic cooling operation of the engine 11.

At step S4, the operation control part 320 causes a timer to start counting. Here, a time set by the setting part 330 is set as the time to be counted by the timer, and the timer starts counting down.

At step S5, the operation control part 320 determines whether the timer has reached zero, that is, determines whether the time set by the setting part 330 has passed. If the timer has not reached zero (S5 •NO), step S5 is repeated. If the timer has reached zero (S5 •YES), the process of the controller 30 proceeds to step S6.

At step S6, the operation control part 320 stops the engine 11. Then, the controller 30 ends the process of the automatic cooling operation.

At step S7, the determination part 310 determines to stop the engine 11, that is, determines to stop the engine 11 without performing the automatic cooling operation. Then, the process of the controller 30 proceeds to step S6 to stop the engine 11. Then, the controller 30 ends the process of the automatic cooling operation.

Thus, according to the shovel of this embodiment, by operating only the ignition switch 42 such that the ignition switch 42 is in "STOP" state, it is possible to immediately stop the engine 11. This makes it possible for even an operator who is unaware of the automatic cooling operation function to promptly stop the engine 11 as intended by the operator. For example, when the operator wishes to immediately stop the engine 11 and check the shovel as in the case of the occurrence of an abnormal sound, the operator can promptly stop the engine 11 as intended by the operator.

Furthermore, when the ignition switch 42 is operated such that the ignition switch 42 is in "STOP" state and the controller 30 (the determination part 310) identifies a predetermined operation, the automatic cooling operation is performed and the engine 11 is thereafter stopped. This makes it possible to prevent the engine 11 from burning out.

Here, the predetermined operation identified by the controller 30 is, for example, pressing a switch to which the function of the automatic cooling operation is assigned while the ignition switch 42 is being operated. Thus, by simultaneously pressing the ignition switch 42 and a switch to which the function of the automatic cooling operation is assigned, the automatic cooling operation is performed. For example, while operating the ignition switch 42 with one hand, the operator presses a predetermined switch with the other hand. This makes it possible to prevent the automatic cooling operation from being accidentally performed.

Furthermore, the duration of the automatic cooling operation is a time set as the time to be counted by the timer at step S4. The duration of the automatic cooling operation is preset by the setting part 330. The operator may preset the duration of the automatic cooling operation. For example, the setting part 330 causes a screen for assisting in the setting of a cooling time (for example, an entry screen) to be displayed on the display device 33. The operator enters the duration of the automatic cooling operation by operating the display device 33 of a touchscreen type or operating the group of switches 34. The setting part 330 sets the input value as the duration of the automatic cooling operation. This makes it possible to change the value of the time to be counted by the timer set at step S4.

The duration of the automatic cooling operation may be changed based on the condition of the engine 11. For example, when the temperature of the engine 11 is at or above a first threshold temperature immediately after the performance of high-load work, the duration of the automatic cooling operation may be longer. Furthermore, when the temperature of the engine 11 is below a second threshold temperature, the duration of the automatic cooling operation may be shorter. Furthermore, the duration of the automatic cooling operation may be changed based on the work history of the shovel.

Furthermore, the left travel hydraulic motor LA, the right travel hydraulic motor 1B, the boom cylinder 7, the aim cylinder 8, and the bucket cylinder 9 may be prevented from moving during the automatic cooling operation. For example, the controller 30 controls the proportional valve 31 to introduce a pilot pressure to the bleed valve 177. This fully opens the bleed valve 177, so that it is possible to stop the supply of hydraulic pressures to the actuators to stop the movement of the actuators. Furthermore, the regulator 13 may perform adjustment to reduce the discharge amount of the main pump 14 to reduce a load on the engine 11.

Furthermore, in the process illustrated in FIG. 5, the case in which the determination part 310 determines whether the ignition switch 42 has been operated into "STOP" state at step S1 and determines whether a predetermined operation has been identified at step S2 is illustrated. This, however, is non-limiting. The determination part 310 may determine whether a predetermined operation has been identified at step S1 and determine whether the ignition switch 42 has been operated into "STOP" state at step S2. This makes it possible to start the automatic cooling operation when the ignition switch 42 has been operated into "STOP" state after a predetermined operation has been identified. Furthermore, it is possible to immediately stop the engine 11 when the ignition switch 42 has been operated into "STOP" state without identification of a predetermined operation.

Furthermore, in the case of determining that it is more desirable to perform the automatic cooling operation based on the load condition of the engine 11, the controller 30 may display a recommendation of a cooling operation, such as "PERFORM COOLING OPERATION WHEN STOPPING ENGINE," on the screen of the display device 33. By checking the displayed recommendation, the operator can perform a predetermined operation to activate the function of the automatic cooling operation without fail before operating the ignition switch 42 into "STOP" state. When a predetermined operation to activate the function of the automatic cooling operation is not input in spite of such display of a recommendation, the controller 30 determines that the situation is such that it is desired to quickly stop the engine 11 without performing the automatic cooling operation, and swiftly stops the engine 11.

An embodiment of the shovel is described above. The present invention, however, is not limited to the above-described embodiment, and various variations and modifications may be made without departing from the scope of the present invention described in the claims.

Furthermore, the ignition switch 42, which is described as a single switch corresponding to the start and stop of the engine 11, is not limited to this. Separate switches may be provided for the start and stop of the engine 11.

Furthermore, a remote key (a remote controller) that performs radio communications with the controller 30 of the shovel may be provided.

The remote key may include an engine stop switch to stop the engine 11 (not depicted) and a cooling operation switch to start the automatic cooling operation (not depicted).

In response to the operation of the engine stop switch, the remote key transmits a first signal to indicate that the engine stop switch has been operated to the controller 30 through a radio communication. In response to receiving the first signal, the determination part 310 of the controller 30 determines to stop the engine 11 without performing the automatic cooling operation (S1 •YES, S2 •NO, S7). Then, the controller 30 stops the engine 11 without performing the automatic cooling operation (S6).

In response to the operation of the cooling operation switch, the remote key transmits a second signal to indicate that the cooling operation switch has been operated to the controller 30 through a radio communication. In response to receiving the second signal, the determination part 310 of the controller 30 determines to perform the automatic cooling operation of the engine 11 (S1 •YES, S2 •YES, S4). Then, the controller 30 stops the engine 11 after performing the automatic cooling operation of the engine 11 (S5YES •S6).

The remote key may alternatively include a switch to stop the engine 11 and a switch to which the function of the automatic cooling operation is assigned.

In response to the operation of the switch to stop the engine 11, the remote key transmits a first signal to indicate that the switch to stop the engine 11 has been operated to the controller 30 through a radio communication. In response to receiving the first signal, the determination part 310 of the controller 30 determines to stop the engine 11 without performing the automatic cooling operation (S1 •YES, S2 •NO, S7). Then, the controller 30 stops the engine 11 without performing the automatic cooling operation (S6).

In response to the operation of both of the switch to stop the engine 11 and the switch to which the function of the automatic cooling operation is assigned, the remote key transmits a second signal to indicate that both of the switch to stop the engine 11 and the switch to which the function of the automatic cooling operation is assigned have been operated to the controller 30 through a radio communication. In response to receiving the second signal, the determination part 310 of the controller 30 determines to perform the automatic cooling operation of the engine 11 (S1 •YES, S2 •YES, S4). Then, the controller 30 stops the engine 11 after performing the automatic cooling operation of the engine 11 (S5YES •S6).

A predetermined operation that is performed simultaneously with the operation of the ignition switch 42 is not limited to operating a switch.

What is claimed is:

1. A shovel comprising:

an upper swing structure;

a lower traveling structure;

a first switch configured to stop an engine; and a hardware processor configured to control the engine, wherein the hardware processor is configured to determine to start an automatic cooling operation in response to recognizing that a predetermined operation to activate a function of the automatic cooling operation and an operation to stop the engine on the first switch have been simultaneously performed.

2. The shovel as claimed in claim 1, wherein the hardware processor is configured to determine not to start the automatic cooling operation in response to recognizing that the operation to stop the engine has been performed on the first switch without recognizing the predetermined operation.

3. The shovel as claimed in claim 1, wherein the predetermined operation is operating a second switch different from the first switch.

4. A shovel comprising:

an upper swing structure;

a lower traveling structure;

a first switch configured to stop an engine; and a hardware processor configured to control the engine, wherein the hardware processor is configured to determine to start an automatic cooling operation in response to recognizing that a predetermined operation to activate a function of the automatic cooling operation and an operation to stop the engine on the first switch have been performed within a predetermined period of time, the predetermined operation is operating a second switch different from the first switch, and the second switch is a momentary action switch that turns on only while being pressed, the second switch being placed in a cabin.

5. The shovel as claimed in claim 1, wherein the automatic cooling operation stops the engine after passage of a set time.

6. The shovel as claimed in claim 5, wherein the hardware processor is configured to set the set time.

7. The shovel as claimed in claim 5, wherein the set time is changed based on a condition of the engine.

8. The shovel as claimed in claim 1, further comprising:

a remote controller configured to perform a radio communication with the controller, wherein the remote controller includes an engine stop switch configured to stop the engine; and a cooling operation switch configured to start the automatic cooling operation.

9. The shovel as claimed in claim 1, wherein the predetermined operation is performed via a display and input device placed in a cabin.

10. The shovel as claimed in claim 1, wherein a screen recommending a cooling operation is displayed on a display and input device placed in a cabin.

11. The shovel as claimed in claim 1 wherein the engine is started in response to a command to start the engine being input to the controller after the engine is stopped, when a gate lock valve is in a locking state.

12. The shovel as claimed in claim 4, wherein the hardware processor is configured to determine to start the automatic cooling operation in response to recognizing that one of the predetermined operation or the operation to stop the engine on the first switch has been performed within the predetermined period of time after performance of the other of the predetermined operation or the operation to stop the engine on the first switch.

* * * * *